United States Patent [19]

Stahlkopf

[11] Patent Number: 4,521,163

[45] Date of Patent: Jun. 4, 1985

[54] OSCILLATING DISPLACEMENT PUMP

[75] Inventor: Friedrich R. R. Stahlkopf, Büchen, Fed. Rep. of Germany

[73] Assignee: O.T. Pumpen GmbH & Co. KG, Fed. Rep. of Germany

[21] Appl. No.: 506,903

[22] Filed: Jun. 23, 1983

[30] Foreign Application Priority Data

Apr. 30, 1983 [DE] Fed. Rep. of Germany ... 8312806[U]

[51] Int. Cl.[3] ..... F04B 31/02; F04B 15/02; F16J 15/18

[52] U.S. Cl. ..... 417/238; 417/567; 417/900; 92/168

[58] Field of Search ..... 417/567, 568, 900, 238; 92/168

[56] References Cited

U.S. PATENT DOCUMENTS

| | | | |
|---|---|---|---|
| 607,845 | 7/1898 | Gale | 417/568 |
| 1,531,616 | 3/1925 | Jacobson | 417/539 |
| 1,991,342 | 2/1935 | Ball | 417/900 |
| 2,561,227 | 7/1951 | Reed | 417/238 |
| 2,678,609 | 5/1954 | Ashton | 417/900 |
| 2,836,122 | 5/1958 | Johnson | 417/900 |
| 2,989,227 | 6/1961 | Statham | 417/238 |
| 3,787,149 | 1/1974 | Dawe | 417/566 |
| 3,994,631 | 11/1976 | Heestetter | 417/900 |
| 4,067,666 | 1/1978 | Richards | 417/900 |
| 4,230,160 | 10/1980 | Bockley | 417/567 |

FOREIGN PATENT DOCUMENTS

| | | | |
|---|---|---|---|
| 517377 | 6/1976 | Fed. Rep. of Germany | 417/900 |
| 2448052 | 10/1980 | Fed. Rep. of Germany | 417/900 |

*Primary Examiner*—William L. Freeh

*Attorney, Agent, or Firm*—Lane, Aitken & Kananen

[57] ABSTRACT

An oscillating displacement pump particularly adapted for pumping a viscous and abrasive fluid medium or one loaded with solid particles. The pump includes a connecting space located outside of a displacement unit and directly connecting a suction valve space with a pressure valve space so that the geodetic height of pumped medium increases. The connecting space defines a suction valve side connecting channel and a pressure valve side connecting channel connected at any given time with each other through the displacement unit space independent of the position of the displacement unit. The pumped medium can thus be moved through the pump from the suction valve to the pressure valve without diversion in a separate connecting space reducing abrasive wear on the pump. A number of additional advantageous features of the pump are disclosed.

22 Claims, 7 Drawing Figures

OSCILLATING DISPLACEMENT PUMP

BACKGROUND OF THE INVENTION

The invention relates to a displacement pump with an oscillating method of operation, particularly adapted for the pumping of a dense or abrasive liquid medium or one containing solid particles. More particularly, this invention relates to an oscillating displacement pump which is preferably equipped with a piston drive which is acted upon by a hydraulic pressure medium and drives a displacement unit wherein the piston drive has a constant or adjustable stroke or stroke frequency.

Embodiments of pumps are known which are unsatisfactory with respect to guiding the flow of a pumped medium, their operating behavior, and their ease of maintenance of the entire pump. For example, in a known pump, the suction and pressure valves are positioned at the same height at opposing points in the housing jacket of a cylindrical pump housing. This design requires that the entire medium be pumped through the pump housing and thus past the displacement unit itself. In addition, this arrangement requires a four part, right angle turn-around of the pumped medium, with a turn-around in each valve housing. The known flow guidance through the pump not only results in an increased pressure loss within the pump, but also subjects all structural pump parts which are exposed to the full flow of the pumped medium to increased wear.

With such a pump, self-acting ventilation of the displacement unit housing through the valves, particularly during startup of the pump, is not possible since the valves are located at about the same height and positioned diagonally relative to the direction of motion of the displacement unit. In the known pump, the displacement unit has the form of a plunger piston. In addition, there is a pump in the displacement unit housing beneath the plunger piston. The sump can only be emptied by means of time-consuming measures on the part of the maintenance personnel.

Other known pumps of the general type initially mentioned display either all or some of these disadvantages.

SUMMARY OF THE INVENTION

Directed to pumps of the types described at the outset, which are primarily used to pump a viscous and abrasive medium or one loaded with solid particles, the main objectives of the invention are to improve the flow guidance of the pumped medium within the pump, to reduce wear of the pump parts, in such a way as to simplify the exchange of worn parts, and to achieve a self-acting ventilation and a simple, time-saving emptying of the pump. Furthermore, dismantling of the displacement unit and, if necessary, its seals, is possible for the entire pump aggregate without an exhaustive disassembly. A further objective of the invention is to change the pump flow by changing the form and dimensions of the single embodiment of the pump housing and its secondary parts, the necessary structural changes being simple and performed exclusively on the displacement unit housing.

These objectives are achieved by the present invention in that a connecting space directly connecting a suction valve and a pressure valve is placed outside of a displacement unit chamber so that the pumped medium passes through the connecting space in such a way that the geodetic height of the pumped medium increases. Preferably, the connecting space is straight and direct.

Two connecting channels are provided, which, independent of the position of the displacement unit at any given time, are connected with each other through the displacement unit space. On one hand, the connecting channel on the suction valve connects the displacement unit space in the area of a housing floor with the suction valve side end of the connecting space by way of a downward incline. On the other hand, a connecting channel on the pressure valve side connects the displacement unit space with the pressure valve side end of the connecting space by way of an upward incline.

In a particularly advantageous form of the invention, the direction of the motion of the displacement unit is vertical. Thus, the axes of the suction valve space, the connecting space, and the pressure valve space, which coincide with the main direction of flow of the pumped medium, are aligned with each other and lie parallel to the direction of motion of the displacement unit. The housing floor has a steady downward incline which begins on the side of the displacement unit housing opposite the suction valve side connecting channel and continues smoothly in the connecting channel until it reaches a lower seat ring in the suction valve space or a suction channel in an attachment flange.

The advantages achieved by the invention reside particularly in the fact that the pump medium is moved through the pump, from the suction valve side to the pressure valve side, without diversion and in a separate connecting space, preferably parallel to the direction of motion of the displacement unit. The medium thus moves through the suction and pressure valve spaces in the same direction of flow as that in the connecting space, in a straight line, without deflection. In contrast to known designs, in which the entire quantity of pumped material is passed through the displacement unit and is acted upon by the displacement unit, in the invention, a portion of the total pumped volume, corresponding to the stroke volume of the displacment pump, is oscillated within the two respective connecting channels between the displacement unit space and the connecting space. The geometric and volumetric relationships within the pump housing thus assure that the medium entering the connecting space through the suction valve and the medium already in the connecting space do not come into immediate contact with the displacement unit either during the suction stroke or during the pressure stroke. This advantage is achieved by the fact that the portions of a pumped liquid close to the displacement unit take part in the exchange of liquid within the pump only to a very limited degree. The portion of the total medium within the pump housing which oscillates in the area of the displacement unit within the displacement unit housing and in the connecting channels thus resides within the pump for a relatively long period of time. This dwell period has a tendency to clarify the pumped medium of solid particles and abrasive impurities, with the result that residual material remaining in the housing for a longer period of time acts as a buffer liquid to keep the medium containing fresh abrasive material or solid particles at a distance from the structural parts of the pump which are subject to wear, such as the displacement unit and its seals. This protective buffering effect becomes greater as the stroke volume of the displacement unit diminishes relative to the total volume of the pump. Since the two connecting channels are connected with each other through the displacement unit space at any given time independent of the position of the displacement unit, self-activating ventilation of the displacement unit space is possible, particularly upon pump startup, by way of the upper connecting channel leading to the pressure valve housing. With the housing floor, provided with a downward incline to the seat ring in the suction valve space or to a suction channel in the connecting flange, the pump can be emptied simply and quickly by means of the secondary structural parts on the suction side.

In order to improve the flow guidance of the pumped medium in the area of the suction and pressure valves, to reduce wear, and to increase its ease of maintenance, another embodiment of the invention employs suction and pressure valve space which are spherical in shape and have substantially the same form and the same characteristic dimensions. All other corresponding structural parts of the valves such as its lids with catch rings, quick-action clamping devices, closing members, and seat rings, are identical in form, dimensions, and material.

In one embodiment of the invention, the closing member for either or both of the suction valve or the pressure valve consists of an elastomer vulcanizate, which reduces the wear on these structural parts, otherwise particularly subject to wear, and which also reduces the noise level in the pump.

In a further embodiment of the invention. the closing members are spherical in form, thus improving the flow and resistance conditions in the suction and pressure valves.

In a further embodiment of the invention, the closing member is reinforced with a core, whose density is greater than that of the casing. The force is homogeneous and lies equidistant from the external surface of the closing member. These features of the closing member improve its opening and closing behavior, as well as the sealing of the closing member.

To reduce wear on the seat ring and the noise level emanating from this area, one embodiment of the invention provides a seat ring with a seat seal, which is form-fitted and force-fitted and which is preferably produced from an elastomer vulcanizate.

In a further embodiment of the invention, it is effective to provide the fitting that borders the stroke motion of the closing member in the form of a catch ring, joined with the lid of the suction valve or pressure valve by means of a connecting web. The catch ring form of the fitting, with an opening for the medium, provides the necessary stroke of the closing member at all times. Furthermore, the catch ring can by very easily disconnected by means of the lid attached to it by the connecting web.

To assure uniform wear on the spherical closing member, in a further embodiment of the invention, the axis of the annular catch ring has a radial offset X, in relation to the bore axis of the seat ring. With this feature, a twisting motion is superimposed on the normal stroke motion of the spherical closing member which makes it impossible for the spherical closing member to return to its original position, thus largely preventing worn areas at certain points on the closing member.

The ease of maintenance of the pump around the suction valve and pressure valve is improved in another embodiment of the invention by form-fitting and force-fitting the lid of the valve housing onto the suction valve opening or the pressure valve opening by means of a quick-action clamping device. This eliminates the need for a time-consuming removal of various connecting members when maintenance is required.

The advantageous flow guidance of the pumped medium in the area of the suction valve and the pressure valve is assured when the suction valve space is integrated in a connecting housing and when the pressure valve space is defined by an independent pressure valve housing outside of the connecting housing.

The cost-effective arrangement of the suction valve and the pressure valve is measured in another embodiment in which the suction valve has a suction valve housing that is structurally identical to the pressure valve housing of the pressure in all of its parts, and wherein the suction valve housing is connected to an attachment flange on the connecting housing.

To assure that the displacement unit and, when necessary, its seals, can be dismantled without a time-consuming dismantling of the entire pump aggregate, in one embodiment of the invention, a drive rod, connected to a drive aggregate, is connected in a readily detachable fashion by a joint bolt to an articular part attached to the displacement unit in such a way as to allow it to be detached. The drive aggregate is secured above a cross-piece which is held by a lantern housing, at a distance from the upper edge of the displacement unit housing, that is greater than the disassembly height of the displacement unit.

In a further embodiment of the invention, the displacement unit is designed in the form of a plunger piston. By changing the diameter of the plunger piston, a further embodiment of the invention allows the pumped flow of the displacement pump to be changed selectively; with an otherwise unmodified displacement pump only a seal housing, a pressure sleeve, and sealing elements need be adapted to the selected plunger piston with the remaining components of the unmodified pump remaining unchanged. With a displacement unit housing and its secondary structural parts that are uniform in form and dimensions, this feature modifies the pumped flow of the pump. An even greater advantage is that pumps with differing pumped flows, and with relatively simple piston drives, whose stroke and stroke frequency are constant, can be readily outfitted since the necessary but extremely simple structural modifications are confined to the displacement unit housing. The final result is a cost-effective pump series with differing outputs.

A further embodiment of the invention, in which the displacement unit has the form of a plunger piston, provides sealing elements which can be adjusted by means of intermediate rings which are placed between the seal housing and the pressure sleeve. Thus, in a very simple way, the sealing wear can be compensated by means of adjustment.

In another form of the invention, a recess is formed over the entire inner bore circumference of the pressure sleeve. The recess forms, in conjunction with the plunger piston, an annular chamber with two opposing connection openings. This construction makes it possible to cleanse the plunger piston, drawn out by way of the seals in the direction of drive, from foreign matter and abrasive substances which were introduced to the plunger piston from the displacement unit space through the seal area. This feature also permits the annular chamber to be cleaned with rinsing water by way of the two openings. Rinsing has the effect of considerably reducing wear on both the plunger piston and the seals, since abrasive substances or solid matter from the pumped medium cannot be returned to the sealing area during a compression stroke of the pump.

A further embodiment of the invention employs a plunger piston in the form of a hollow body. The weight of the moving piston mass is thus considerably reduced thereby and structural material is saved.

In another form of the invention, the displacement unit is in the form of a disk piston. The pumped flow can be changed in this embodiment by modifying the diameter of the disk piston. In this instance, as with the plunger piston embodiment, all advantages of the displacement pump are retained with respect to the flow guidance of the pumped medium, wear performance of the structural parts of the pump, and ease of maintenance of the pump. Adjusting the pump housing to a modified disk piston diameter is possible in such an embodiment of the invention inasmuch as only a sleeve needs to adapted to the disk piston in the otherwise unchanged displacement pump.

In still another form of the invention, the disk piston, like the plunger piston, is in the form of a hollow body, thus considerably reducing the moving mass of the disk piston and the needed structural material.

In a further form of the invention, the displacement unit is in the form of a diaphragm. With the diaphragm arrangement, areas for application of the pump are opened in which the use of displacement pumps with plunger or disk pistons is not otherwise possible due to the absence of suitable seal materials. However, the operating life of the diaphragms is limited as is the axial deflection that in each case determines the stroke volume of the diaphragm. As is the case of the plunger piston and disk piston forms of a displacement unit, the pumped flow of the displacement pump is selectively modified in dependence on the outer diameter of the diaphragm. It is thus only necessary to adapt only two outer diaphragm clamping means to the given diaphragm in an otherwise unmodified displacement pump to accommodate diaphragms of differing diameters.

These and other features and advantages of the oscillating pump according to the invention will become more apparent from the following written description of the preferred embodiments of the invention.

BRIEF DESCRIPTION OF THE DRAWINGS

Examples of the preferred embodiments of the invention are shown in the drawings and are described in greater detail below.

In The Drawings.

DETAILED DESCRIPTION OF THE PREFERRED EMBODIMENTS

Figure 1:
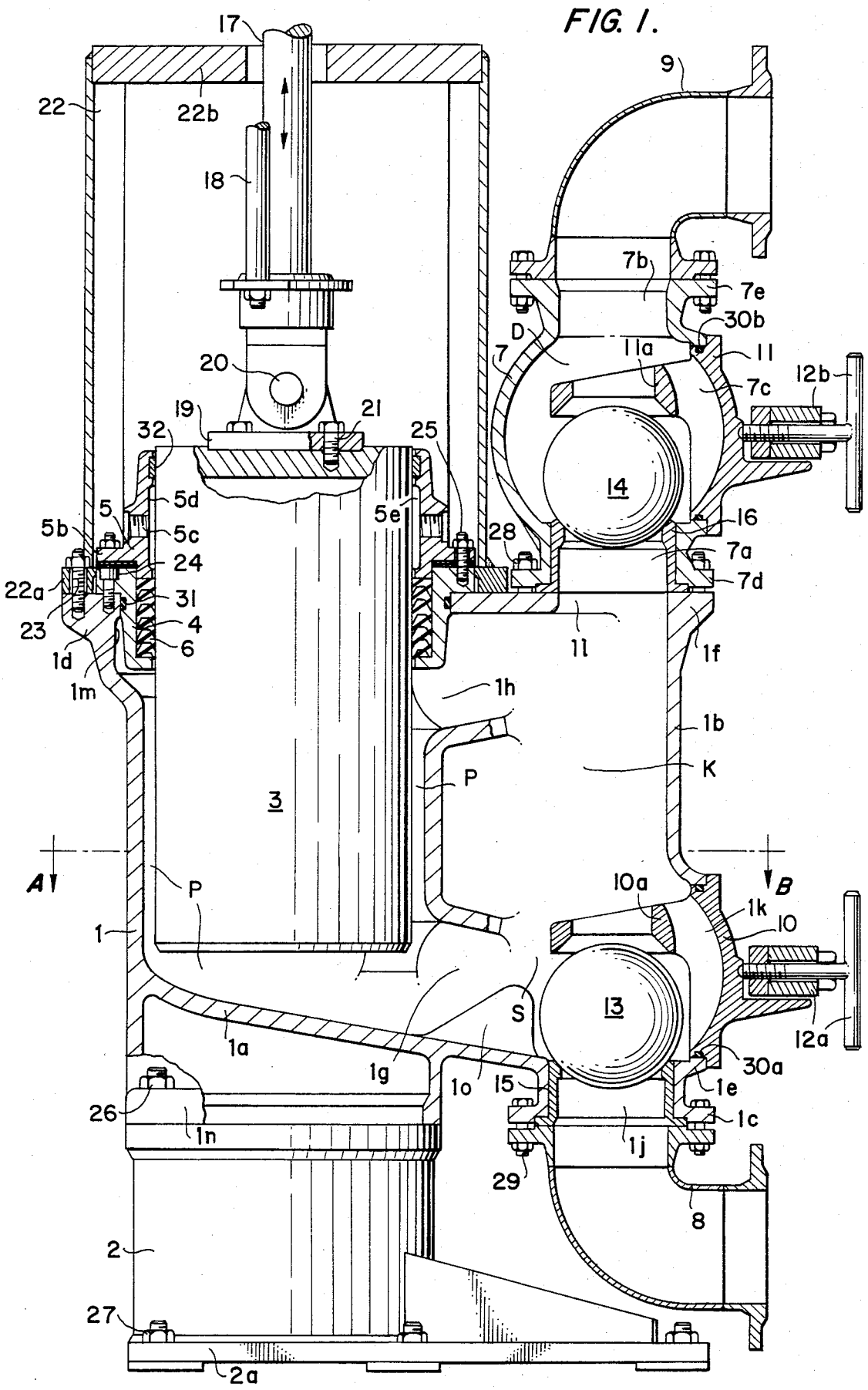
FIG. 1 is a cross-sectional view through a displacement pump according to the invention, with a displacement unit in the form of a plunger piston.

As shown in FIG. 1, the pump housing, which is preferably formed as a single-piece casting or welded part, consists of a displacement unit housing 1 with a cylindrical form defining a displacement unit space P, and having a vertically-aligned center axis. The pump housing included a connecting housing 1*b* defining a connecting space K, located parallel to the displacement unit housing 1, and two connecting channels 1*g* and 1*h*, each of which, and at a distance from the other, connects the displacement unit space P formed by the displacement unit housing 1 with the connecting space K defined by the connecting housing 1*b*.

A housing floor 1*a* with a steady downward incline is provided on the lower surface of the displacement unit housing 1. This incline begins at the side of the displacement unit housing 1 which lies opposite to the lower connecting channel 1*g* and continues smoothly in the connecting channel 1*g* until it reaches a suction channel 1*j* formed in a connecting flange 1*c* on the connecting housing 1*b*.

Figure 2:
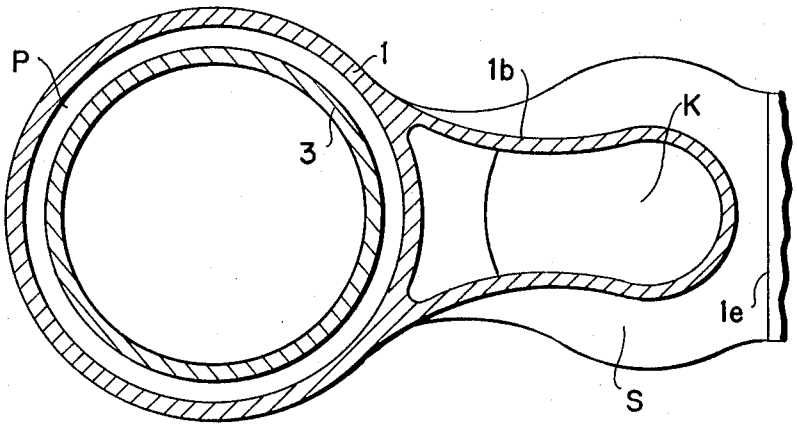
FIG. 2 is a cross-sectional view taken along lines A-B of FIG. 1 through the displacement pump of the invention.

FIG. 2 shows a cross-section of the displacement unit housing 1 and the connecting housing 1*b* for the embodiment of FIG. 1 taken along the section A-B. The pump housing includes four outward openings: namely, the suction channel 1*j* in the connecting flange 1*c* mentioned above for receiving the fluid to be pumped; a housing opening 1*m* in a housing attachment 1*d*; a pressure channel 1*l* in a pressure valve housing attachment 1*f* for expelling the pumped fluid; and a suction valve opening 1*k* formed in a lid attachment 1*e* in the connecting housing 1*b*. The axes of symmetry of the suction channel 1*j* of the pressure channel 1*l* and the center axis of the connecting space K are aligned with each other. A spherical suction valve space S is formed above the suction channel 1*j* and within the connecting housing 1*b*, in which suction valve space S, as mentioned above, the connecting channel 1*g* on the suction valve side feeds into the downwardly-sloped incline defined by the housing floor 1*a* of the displacement unit space P.

Figure 3:
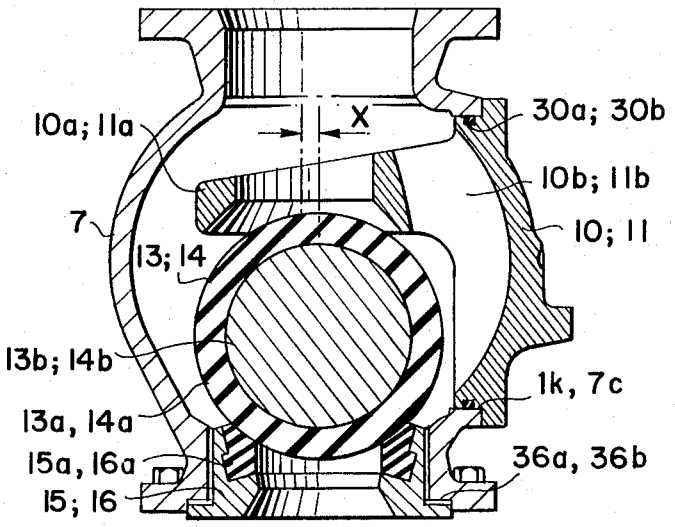
FIG. 3 is a cross-sectional view through a pressure valve of the displacement pump of the invention.

A lower seat ring 15 is formed and force-fitted into the suction channel 1*j* and the connecting ring 1*c*, which seat ring 15 is closed by a spherical closing member 13. The suction valve opening 1*k*, by means of which the suction valve space S is accessible from the outside, can be closed or sealed by means of a lid 10 in conjunction with a lower lid seal 30*a*. A catch ring 10*a*, which is connected with the lid 10 by connecting piece 10*b* (shown more clearly in FIG. 3), limits the stroke motion of the lower closing member 13 at the top of the stroke. The lid 10 is formed and force-fitted to the lid attachment 1*e* by means of a quick-action clamping device 12*a*. A guide rib 1*o* centrally placed in the suction valve side connecting channel 1*g* assists in vertically guiding the lower closing member 13. A suction bend 8 is connected to the connecting flange 1*c* by a connecting element 29; the suction bend 8 thus provides a horizontal suction line connection to the pump and protects the lower seat ring 15 from axial displacement.

The suction valve space S, the lower seat ring 15, the lower closing member 13, the lid 10 with the catch ring 10*a*, and the quick-acting clamping device 12*a* thus form a suction intake valve integrated into the connecting housing 1*b*. A pressure outlet valve formed by an independent pressure valve housing 7 is formed above the connecting housing 1*b* in the axial extension of the pressure channel 11. The pressure valve is connected to the pressure valve housing attachment 1*f* by a lower connecting flange 7*d* and a connecting element 28. A pressure valve space D bordered by the pressure valve housing 7 has a spherical form like the suction valve space S and, if present, has the form and characteristic dimensions of the suction valve space S. The remaining structural parts of the pressure valve, such as a lid 11 with a catch ring 11*a*, a quick-action clamping device 12*b*, a closing member 14, and a seat ring 16 are identical in form, dimensions, and material to the corresponding parts identified by the reference numerals 12*a*, 13, and 15 of the suction valve as previously described. An inlet opening 7*a*, which smoothly connects with the pressure channel 11 is located within the upper seat ring. In cooperation with the upper lid sealing 30*b*, the lid 11 closes a pressure valve opening 7*c*, which opens the pressure valve space D in the outward direction. An upper terminal opening 7*b* of the pressure valve housing 7 extends to form a pressure bend 9 connected to an upper connecting flange 7*e*.

In a further embodiment of the invention (not shown) the suction valve and the pressure valve each represent idependent structural parts and are positioned beneath the connecting flange 1*c* of the connecting housing 1*b*.

In the displacement unit housing 1, beneath the housing floor 1*a*, there is a housing base 1*n* through which a connection of the pump housing, with a support 2, is placed by means of a connecting element 26. An attachment plate 2*a* is connected to the support 2, which both assures a tilt-free support to the center of gravity of the entire pump aggregate and provides the necessary ground clearance between the pump. Connecting elements 27 in the attachment plate 2*a* secure the entire pump aggregate on its base.

The characteristic structural part of the embodiment shown in FIG. 1 is a displacement unit in the form of a plunger piston 3. As can be seen from the drawing, the plunger piston has a hollow body and a cylindrical form. The oscillating drive for the plunger piston 3 is transmitted by a drive rod 17, which leads to a piston drive (not shown), preferably acted upon by a hydraulic medium. A control rod 18 serves to control the change in motion in the upper and lower dead centers of the plunger piston 3. The latter can be detached, along with the drive rod 17, by means of an articular part 19 and a joint bolt, and connected in articular fashion on a single plane. The articular part 19 is formed and force-fitted with the upper floor of the plunger piston 3 by means of the connecting element 21.

Several axially interlocking sealing elements 6, which surround the plunger piston 3 and seal the displacement unit space P against the pump surroundings, are arranged in a sleeve-like sealing housing 4. The sealing housing 4 interlocks with the displacement unit space P by way of the housing opening 1*m* in the housing attachment 1*d* and is form-fitted and force-fitted by means of its flange and a connecting element 24 to the housing connection 1*d*. A housing seal 31 arranged in the outer jacket surface of the sealing housing 4 seals the housing opening 1*m* in the outward direction. A pressure sleeve 5 meshing with a snap ring groove formed by the plunger piston 3 and the sealing housing 4 serves to prestress the sealing elements 6 and to adjust them in the case of sealing wear during operation of the displacement pump. A flange 5*b* is attached to the pressure sleeve 5. The flange 5*b* is form-fitted and force-fitted to the flange portion of the sealing housing 4 by means of a connecting element 25. A recess is formed over the entire inner bore circumference of the pressure sleeve 5. The recess thus forms an annular chamber 5*e* in conjunction with the plunger piston 3. The annular chamber 5*e* is provided with two opposing connection openings to which a rinsing line can be attached, A guide ring 32, located above the circular recess 5*d* and within the bore of the pressure sleeve 5, serves to guide the plunger piston 3 and restricts any leakage through the guide slot between the plunger piston 3 and the guide ring 32.

A lantern-shaped housing 22, so-called because of its structural resemblance to a conventional lighting lantern, with two large opposing openings at its sides, is connected to the displacement unit housing 1 by way of its attachment flange 22*a* and ends at a cross piece 22*b*, on the upper side of which the drive aggregate for the displacement pump is placed. The lower edge of the crosspiece 22*b* is held by the lantern-shaped housing 22 at a distance from the upper edge of the displacement unit housing 1, which is higher than the plunger piston 3, and greater than the disassembly height of the displacement unit. With this arrangement, it is possible to remove the plunger piston 3 and its bordering parts from the displacement unit housing 1, without dismantling the drive aggregate connected to the lantern housing 22 and its crosspiece 22*b*.

The cross-sections of the displacement unit housing 1 and of the connecting housing 1*b* can be seen from section A-B (FIG. 2), as can the spherical form of the suction valve space S within the connecting housing 1*b*. It can also be seen that, in the area of the section plane, the displacement unit space P is separated from the connecting space K by the cylindrical jacket of the displacement unit housing 1. At the same time, the figure shows that, independent of the given position of the plunger piston 3, the connecting channels 1*g* and 1*h* on the suction valve side and pressure valve side connect with each other at the least by way of the annular opening formed between the displacement unit housing 1 and the plunger piston 3.

A lid attachment 1*e* is located in the area of the suction valve space S at the connecting housing 1*b*. A suction valve opening (not shown) of the lid attachment 1*e* provides simple and fast access to areas within the pump housing.

The pressure valve (FIG. 3) and the independent pressure valve housing 7 were described in conjunction with the integrated suction valve in the description accompanying FIG. 1. The double reference numerals in FIG. 3 indicate which valve parts are identical with respect to form, dimension, and material. The shown embodiment of a pressure valve of the displacement unit pump under the invention also shows several other advantageous features, which are provided by the same features as those corresponding elements of the suction valve. The closing member 13 or 14 is equipped with a core 13*b* or 14*b*, having a density which is greater than that of its jacket 13*a* or 14*a*. The core 13*b* or 14*b* is homogeneous and its position is equidistant from the external surface of the closing member 13 or 14. The jacket 13*a* or 14*a* preferably consists of an elastomer vulcanizate. Likewise, a seat seal 15*a* or 16*b* is form-fitted and force-fitted in the seat ring 15 or 16. The seat seal 15*a* or 16*a* also preferably consists of an elastomer vulcanizate. In conjunction with the corresponding closing member 13 or 14, the seat seal will reduce wear at the seat of the valve and considerably reduce the noise caused during operation of the displacement pump by motion within the valves. A valve housing seal 36*a* or 36*b* is located between an attachment on the seat ring 15 or 16 and the connecting flange 1*c* or 7*d* (see FIG. 1) associated with it, which valve housing seal assures the outward sealing of the corresponding valve space. Within the suction or pressure valve opening 1*k* or 7*c*, the lid 10*b* or 11*b* is sealed by means of the lower or upper lid seal 30*a* or 30*b*.

To assure a uniform wear on the spherical closing member 13 or 14, the axis of the circular and annular catch ring 10*a* or 11*a*, which is held in place by a connecting piece 10*b* or 11*b* positioned in the middle of the lid 10 or 11, has a radial offset shown by the reference X, in relation to the bore axis of the seat ring 15 or 16.

This embodiment has the following effect. If the closing member 13 or 14 is lifted from the seat seal 15*a* or 16*a* by the flow medium, the catch ring 10*a* or 11*a* limits the stroke motion of the closing member 13 or 14 within the flow. The closing member 13 or 14 meets the catch ring 10*a* or 11*a* in a position that is slightly off its center. The point of contact of the closing member 13 or 14 with the catch ring 10*a* or 11*a* is arranged to provide a following twisting motion of the closing member 13 or 14, which terminates with the closing member 13 or 14 being centered in the catch ring 10*a* or 11*a*. When the closing member 13 or 14 drops, this process repeats itself. The closing member 13 or 14 thus must center itself in the seat sealing 15*a* or 16*a* and performs a comparable twisting motion around its point of contact with the seat seal 15*a* or 16*a*. The downward directed stroke motion and the superimposed twisting motion terminate with the centering of the closing member 13 or 14 in the seat sealing 15*a* or 16*a*. This coaction avoids excessive wear at one given point on the closing member.

Figure 4:
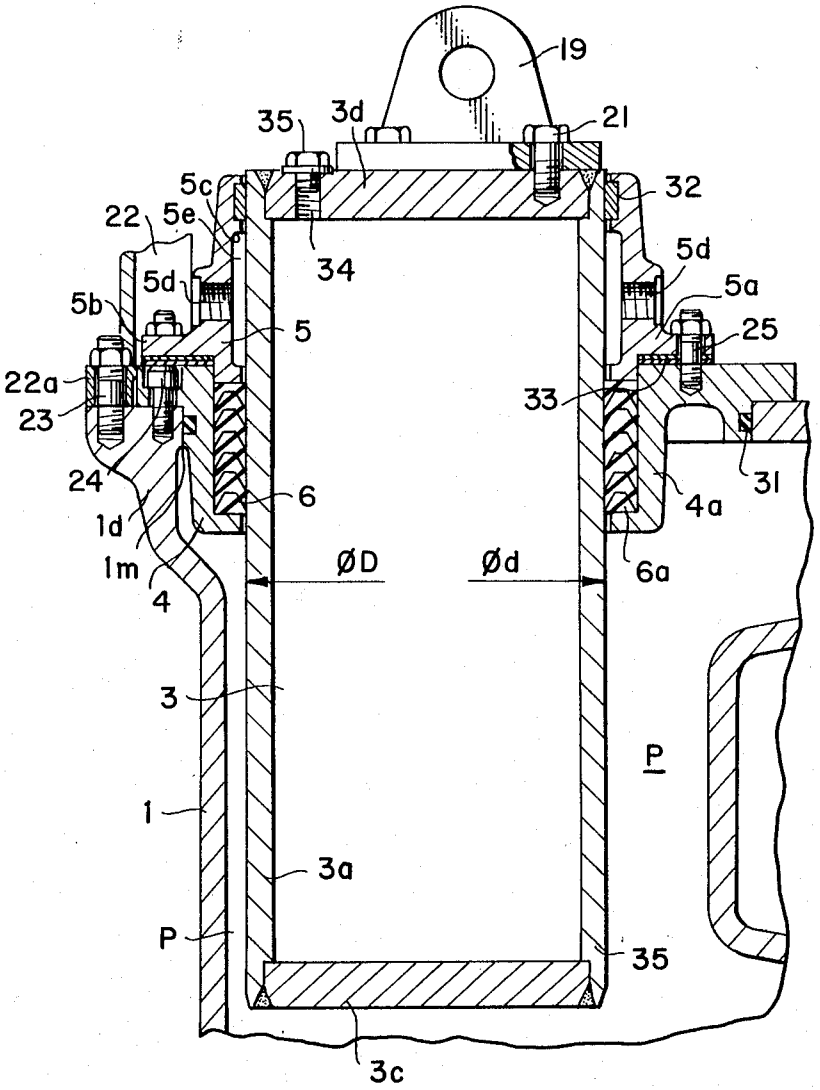
FIG. 4 is a cross-sectional view through the plunger piston and the immediately surrounding parts of the displacement pump.

FIG. 4 shows an advantageous embodiment of the plunger piston 3 and its seal area, as shown in combination with the displacement pump of FIG. 1. At the left of the line of symmetry or center line the plunger piston 3 is an arrangement with the maximum plunger piston diameter $\phi$D, whereas the diagram to the right of the center line shows a plunger piston 3 with a minimum piston diameter $\phi$d. Thus, the pump is readily modified by selecting a piston with a diameter with that range, wherein the pump is readily adapted to accommodate the selected diameter. The components adapted to the minimum diameter $\phi$d are denoted by a reference letter as appended to the reference numeral. This simple feature allows the pumped flow to be selectively modified in an otherwise unmodified displacement pump, so that only the seal housing 4 or 4*a*, the pressure sleeve 5 or 5*a*, and the sealing elements 6 or 6*a* require adaptation to the diameter of the given plunger piston 3, while the remaining components of the displacement pump are unchanged.

In order to reduce the mass and save material, the plunger piston 3 is manufactured from a tubular shell 3*a* or 3*b*, most effectively as a hollow body, with a lower base member 3*c* and an upper cap member 3*d*. To ventilate the hollow space thus formed within the plunger piston 3 with this structure, an opening 34 is applied to the upper cap member 3*d*, which is closed during operation of the displacement pump by means of a locking screw 35. Depending on the differing plunger piston diameters $\phi$ D, $\phi$ d there will be differing annular spaces remaining between the displacement unit housing 1 and the tubular shell 3*a* or 3*b* of the plunger piston of the selected diameter and within the displacement unit space P. These varying annular spaces affect the operating behavior of the displacement pump to the extent that larger annular spaces (for smaller diameter pistons) favor a self-acting ventilation of the displacement unit space P and transport less fresh and abrasive material or material containing solid matter into the area of the plunger piston.

Independent of its size in the area of the sealing elements 6 or 6*a*, seal housing 4 or 4*a*, in cooperation with the housing seal 31, is fitted over a uniform outer diameter into the housing opening in 1*m* formed in the housing attachment 1*d*. The sealing housing 4 or 4*a* is attached to the displacement unit housing 1 by a flange part and a connecting element 24. The pressure sleeve 5 or 5*a*, whose size is adapted to the sealing housing 4 or 4*a*, interlocks with a snap ring groove formed by the sealing housing 4 or 4*a* and with the tubular shell 3*a* or 3*b* of the plunger piston and gives the sealing elements 6 or 6*a* the necessary sealing stress. A limited degree of readjustment of the sealing elements 6 or 6*a* after wear is possible above the intermediate rings 33 and between the sealing housing 4 or 4*a* and the flange 5*b* of the pressure sleeve 5 or 5*a*. The pressure sleeve 5 or 5*a* is form-fitted and force-fitted with the sealing housing 4 or 4*a* by means of its flange 5*b* and a connecting element 25. A recess 5*d*, located over the entire inner circumference of the upper end of the pressure sleeve 5 or 5*a*, forms an annular chamber 5*e* with the plunger piston 3, which chamber 5*e* is fitted with two opposed connection openings 5*c*. A rinsing line can be attached to the connection openings 5*c* on both sides, thus making it possible to continuously or intermittently rinse the annular space 5*e* with a cleaning fluid. This rinse causes abrasive mixtures or solid particles which have entered the annular space 5*e* from the displacement unit space P by way of the sealing elements 6 or 6*a* to be rinsed out, thus reducing wear on the pump parts in this area. The guide ring 32 positioned within the bore at the end of the pressure sleeve 5 or 5*a* guides the plunger piston 3 and at the same time restricts the leakage of rinsing fluid through the slit between the guide ring 32 and the plunger piston 3.

The plunger piston 3 is detachably connected to the drive rod of the drive aggregate by means of the articular part 19, which is connected to the upper cap member 3*d* by means of a connecting element 21, such as a threaded bolt. The details of the drive aggregate are better shown in FIG. 1.

The lantern-shaped housing 22 concentrically encloses the sealing housing 4 or 4*a* and the pressure sleeve 5 or 5*a* and is connected in a detachable manner to the housing attachment 1*d* by means of its attachment flange 22*a* and a connecting element 23.

In operation, the pump generally works as follows. During the upward movement of the plunger piston 3, the pumped medium, as best seen in FIG. 1, enters the suction valve space S of the displacement pump by way of the suction bend 8 and the suction channel 1*j*. During the downward motion of the plunger piston 3, a volume of pumped medium corresponding to the suction intake volume or pumped medium medium is displaced from the displacement unit space P and the connecting space K into the pressure valve space D by way of the pressure channel 1*l* and the inlet opening 7*a*. The pumped medium flows through the suction valve space S and the pressure valve space D in a linear fashion and without being deflected. Suction intake volumes, which enter the displacement unit space P by way of the suction valve side connecting channel 1*g*, with its upward incline to the displacement unit space P, can then rise to the pressure valve side connecting channel 1*h*, to be transported through the pressure side channel 1*l* and the inlet opening 7*a* into the pressure valve space D. Such a pumping action effectively acts as a self-acting ventilation process and is of special advantage when starting the displacement pump.

A further advantage to the pumping action of the pumped medium is afforded by the housing floor 1*a*, with its declining slope from the displacement unit space P to the suction valve space S. This structural feature prevents the settlement of solid matter from the pumped medium in the area within the pump beneath the plunger piston 3. At the same time, the slope of the housing floor 1*a* also makes possible the simple, fast, and automatic voiding of the displacement pump during maintenance and repair work, by means of the suction valve opening 1*k* or the suction channel 1*j*, in cooperation with the suction bend 8 or the suction line attached to it.

Figure 5:
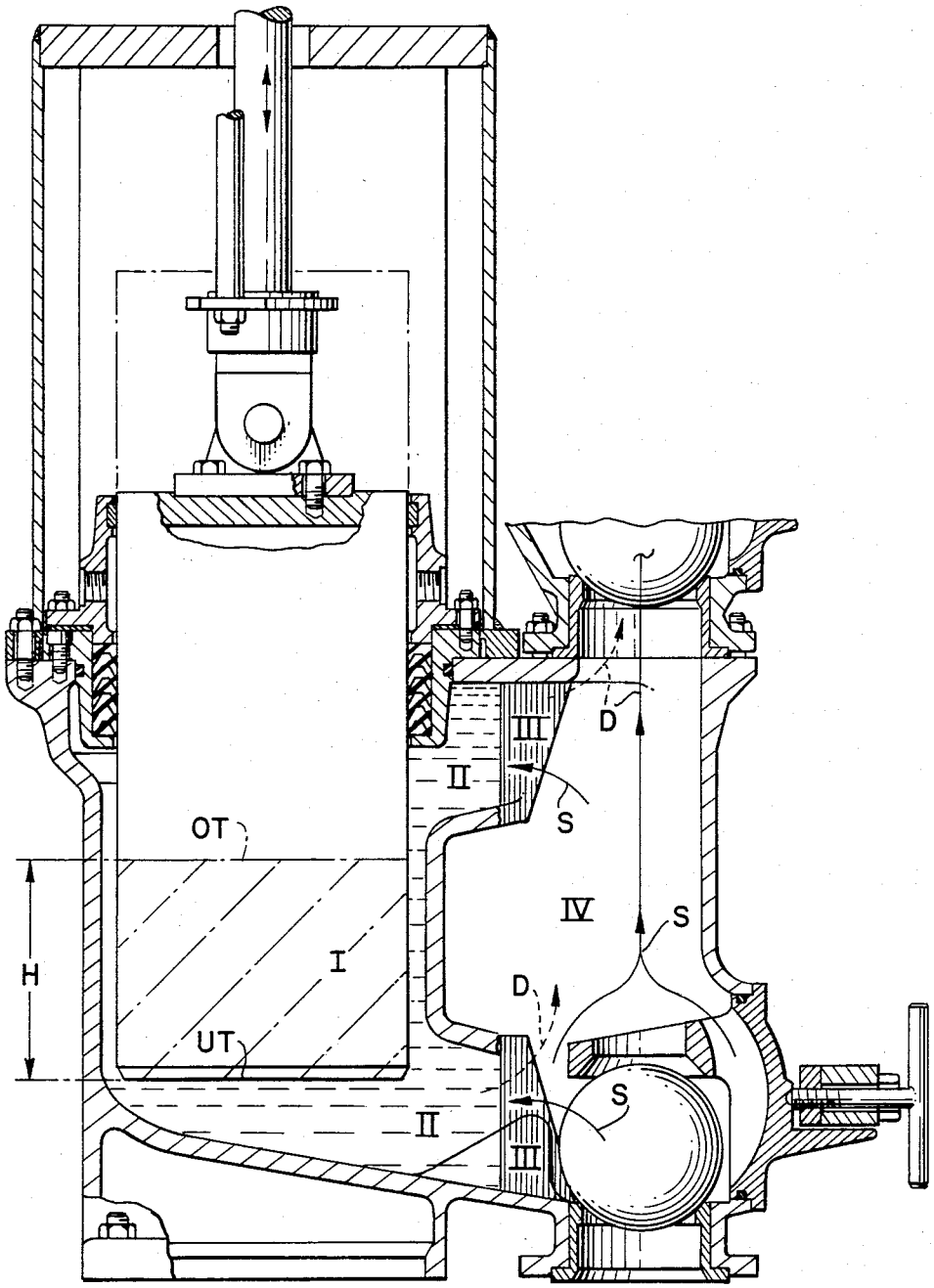
FIG. 5 is a cross-sectional view through a portion of the pump housing of the displacement pump, wherein the final positions of the displacement pump and the resulting partial flows and volume distributions of the pumped medium are qualitatively indicated.

Based on the flows and volume distribution of the pumped medium shown in FIG. 5, the primary flow paths of the medium pumped by the displacement pump will now be described. The displacement pump differs considerably from known designs by virtue of the flow guidance of the pumped medium depicted in FIG. 5, but in a simplified form. The plunger piston is representatively shown in its lower dead center and its upper dead center positions UT and OT, in a form representative of other displacement pump types with a very similar flow guidance in the pump housing. The stroke represented by the reference letter H, together with the area of the piston, determines the stroke volume, which is drawn into the pump during the upward movement of the piston and displaced from the pump in the downward movement of the piston. The stroke volume is shown in a simplified form in FIG. 5 by the cross-hatched space marked with the reference Roman numeral I. During the suction stroke, the space I is filled with a pumped medium drawn from the neighboring spaces marked with the reference Roman numeral II. It can be easily seen from FIG. 5 that the intake volume is not drawn in from the suction space by the suction side connecting channel alone, but that a significant portion of the intake volume of the pumped medium reaches the space I by way of the pressure valve side connecting channel and the annular space between the displacement housing and the plunger piston. The main diagram assumes for analysis that there is a space (identified by the Roman numberal III) in addition to the space II, having a volume which is no longer necessary for filling the stroke volume produced by the plunger piston. This is particularly the case when the plunger piston is relatively small and the stroke volume is considerably smaller than the total volume of the pump housing. Considered in simplified fashion, where there is such an area III, the fresh intake medium will not pass through the suction canal and reach the immediate vicinity of the plunger piston or its seal. Rather the volume of pumped medium in the area III will serve as a buffer. The arrows marked with the reference letter S represent the flows of pumped medium during the suction stroke of the piston, while the arrows marked with the reference letter D represent the flow of the pumped medium during the pressure stroke of the piston.

It will also be seen that space II involves oscillating quantities of the pumped medium in the plunger area and in the area of the connecting channels. These oscillating quantities play only a limited role in an exchange of material within the pump with the pumped medium, so that they have a longer dwell period within the pump, measured by the dwell period of the medium in the area of the connecting channel K. This longer dwell period of the medium in the space II tends to thin out or clarify abrasive mixtures or solid matter in the carrier liquid, with the overall result that wear in the area of the plunger piston and its seals is reduced. The main flow of the pumped medium accumulates in the area identified by the reference Roman number IV from which partial flows S branch out in the area of the connecting channels during the suction stroke of the pump, as shown by the arrows. Depending on the stroke volume of the plunger piston, a partial flow S will remain in the area IV. Partial flows D of the pumped medium flow from the connecting channels into the area IV during the pressure stroke of the plunger piston of the pump. Depending on the stroke volume of the plunger piston, the displacement pump of the invention succeeds in keeping a larger proportion of the pumped flow away from the area of the plunger piston and its seals. In the case where the stroke volumes are small in relation to the total pump volume, the pump completely succeeds in keeping the fresh suctioned medium, which contains abrasive matter or solid particles, from reaching the displacement unit space by way of the oscillating portions of pumped fluid in the connecting channels.

Figure 6:
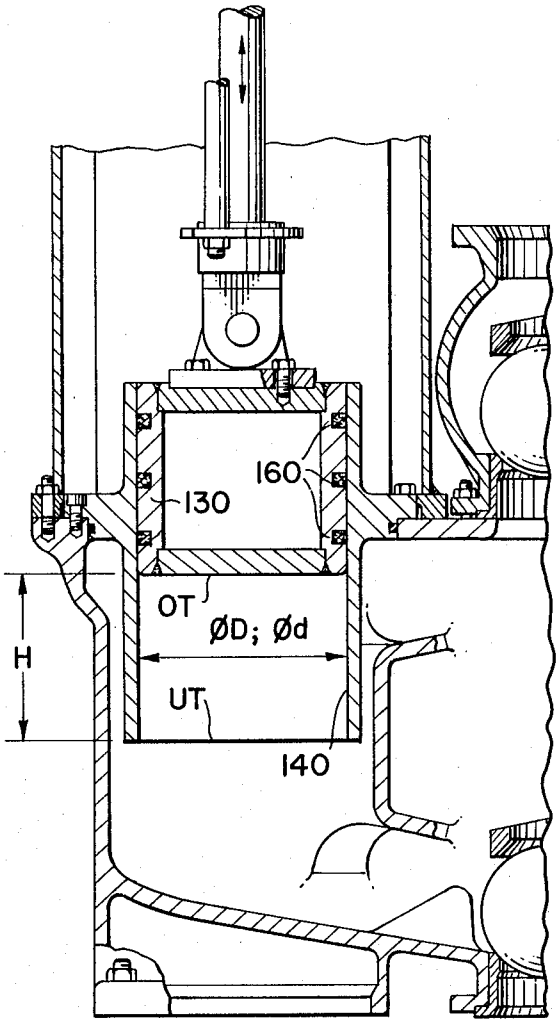
FIG. 6 is a cross-sectional view through another embodiment of the displacement pump, taken in the area of the displacement unit when formed as a disk portion.

In a further embodiment of the displacement pump under the invention, as shown in FIG. 6, the displacement unit has the form of an elongated disk-shaped piston 130. A sleeve 140 is positioned in the displacement space at a depth which is at least the length of the piston stroke H. The disk piston 130 moves upwardly and downwardly entirely within the sleeve 140 in the displacement space. A plurality of sealing elements 160 are arranged on the outer surface of the disk piston 130 intermediate the piston 130 and the sleeve 140. For the remaining components of the pump, all the displacement pump features described in connection with the prior figures, except for the annular chamber rinsing feature, can be provided in the embodiment shown in FIG. 6. The pumped flow of the displacement pump is selectively modified, in dependence on the diameter $\phi$ D or $\phi$ d of the disk piston 130. With a displacement pump which is otherwise unmodified, only the sleeve 140 needs to be adapted to the diameter of the given disk piston 130.

Figure 7:
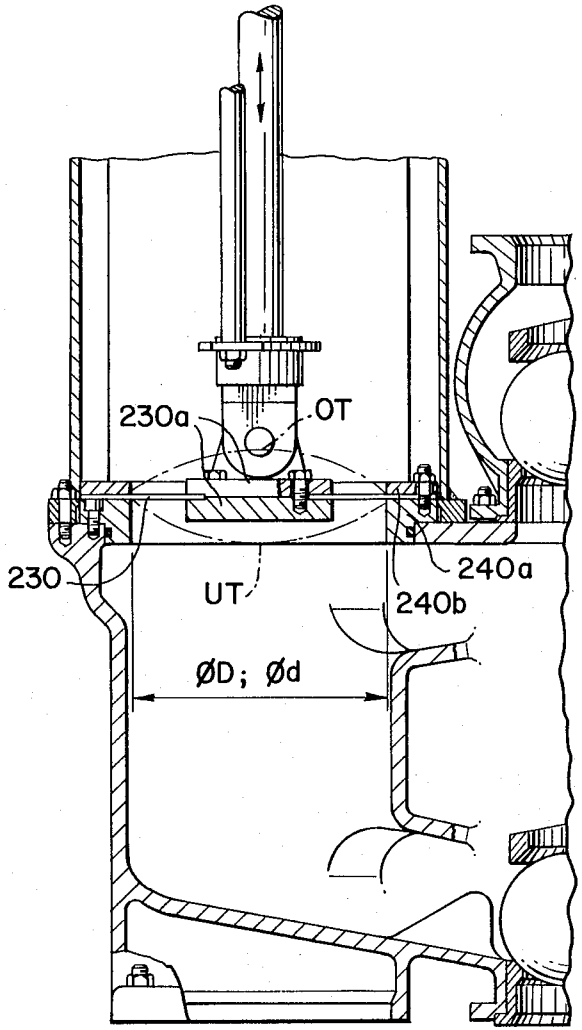
FIG. 7 is a cross-sectional view through another displacement pump embodiment in the area of the displacement unit formed as a diaphragm.

In still another embodiment of the displacement pump of the invention, as shown in FIG. 7, the displacement unit has a diaphragm 230 which is prferably in the shape of a disk. The disk-shaped diaphragm 230 is clamped at its center by inner diaphragm clamps 230*a* which cause it to move between a lower dead center and an upper dead center depicted in FIG. 7 with the legends UT and OT respectively. The flexure of the diaphragm operation between these two positions is shown by the convex and concave dotted and dashed curves. At its outer periphery, the diaphragm 230 is clamped between a pair of external diaphragm clamping means 240*a* and 240*b* which respectively determine the maximum and minimum diaphragm diameters $\phi$ D and $\phi$ d of the effective pumping area of the diaphragm. As shown, these clamping means are generally annular elements, one disposed atop the other with the edge of the diaphragm disposed therebetween. The pumped flow of the displacement pump can be selectively modified merely by changing the diameter of the diaphragm; in an otherwise structurally unchanged displacement pump, only the two external diaphragm clamping means 240*a*, 240*b* need be adapted to the diaphragm. Accordingly, the remaining elements of the pump are like those corresponding elements described in the prior figures so detailed description is not repeated. Displacement pumps of this type, with displacement units in the form of diaphragms, can be used to pump particularly tough and abrasive media, which normally cannot be controlled by the sealing elements necessary in piston pumping. In using the diaphragm 230 in displacement pumps under the invention, the ratio between the diameter and the axial extension of the displacement unit space P shown in the figures should be changed in favor of the diameter. Since the deflection of the diaphragm is dependent on the diaphragm material and is subject to restrictions, this change in ratio will provide an adequate stroke volume for the given diaphragm 230 employed in the displacement unit.

The invention may be embodied in other specific forms without departing from its spirit or essential characteristics. The present embodiments are, therefore, to be considered in all respects as illustrative and not restrictive, the scope of the invention being indicated by the claims rather than by the foregoing description, and all changes which come within the meaning and range of the equivalents of the claims are therefore intended to be embraced therein.

What is claimed is:

1. An oscillating displacement pump, particularly for pumping a liquid medium which is viscous and abrasive or loaded with solid particles, said pump being preferably equipped with a piston drive acted upon by a hydraulic pressure medium and driving a displacement unit having the form of a plunger piston (3), the stroke and/or stroke frequency of which piston drive is constant or variable, which displacement pump has a connecting space (K), which connects a suction valve space (S) with a pressure valve space (D) in such a way that the connection is preferably straight lined and direct, which connecting space (K) is located outside of the displacement unit space (P) and is traversed by the pumped medium in such a way that the geodetic height of the medium increases; and two connecting channels (1*g*, 1*h*) which, independent of the position of the displacement unit (3), at any given time, are connected with each other through the displacement unit space (P) and in which a suction valve side connecting channel (1*g*) connects the displacement space (P) on one hand in the area of a housing floor (1*a*) and by way of a downward incline with the suction valve side end of the connecting space (K) and a pressure valve side connecting channel (1*h*) connects the displacement unit space (P) on the other hand by way of an upward incline with the pressure valve side end of the connecting space (K), said pump further including a sealing housing (4 or 4*a*), a pressure sleeve 5 or 5*a*), a sealing element (6 or 6*a*) structurally adapted to a diameter ($\phi$ D, $\phi$ d) of said plunger piston (3), and a recess (5*d*) formed over the entire inner bore circumference of the pressure sleeve (5 or 5*a*), said recess forming, in conjunction with the plunger piston (3), an annular chamber (5*e*) provided with opposing connection openings (5*c*).

2. The oscillating displacement pump as claimed in claim 1, wherein the suction valve space (S) is integrated into a connecting housing (1*b*), and the pressure valve space (D) is defined by an independent pressure valve housing (7) outside of the connecting housing (1*b*).

3. The oscillating displacement pump as claimed in claim 1, wherein the suction valve has a suction valve housing structurally identical to the pressure valve housing (7) in all parts, which suction valve housing is connected to an attachment flange (1*c*) of the connecting housing (1*b*).

4. The oscillating displacement pump as claimed in claim 1, wherein a drive rod (17) connected to a drive aggregate is connected in detachable fashion to an articular part (19) on the displacement unit (3, 130, 230) by means of a joint bolt (20), and the drive aggregate is secured above a crosspiece (22*b*) which is held, by a lantern housing (22), at a distance from the upper edge of a displacement unit housing (1) that is greater than the disassembly height of the displacement unit (3, 130, 230).

5. The oscillating displacement pump as claimed in claim 1, wherein the pump flow of the displacement pump is selectively modified in dependence on the diameter ($\phi$ D, $\phi$ d) of the plunger piston (3), it being necessary in an otherwise unmodified displacement pump to adapt only a sealing housing (4 or 4*a*), a pressure sleeve (5 or 5*a*), and sealing elements (6 or 6*a*) to the given plunger piston (3).

6. The oscillating displacement pump as claimed in claim 5, wherein the sealing elements (6 or 6*a*) can be adjusted by means of intermediate rings (33) placed between the sealing housing (4 or 4*a*) and the pressure sleeve (5 or 5*a*).

7. The oscillating displacement pump as claimed in one of claims 5 or 6, wherein the piston plunger (3) has the

8. The oscillating displacement pump as claimed in claim 1, wherein the direction of motion of the displacement unit (3, 130, 230) is vertical; axes of the suction valve space (S), the connecting space (K), and pressure valve space (d), which coincide with the primary direction of flow of the pumped medium, align with each other and lie parallel to the direction of motion of the displacement unit (3, 130, 230); and the housing floor (1*a*) has a steady downward incline, which begins on the side of the displacement unit housing (1) opposite the connecting channel (1*g*) and continues smoothly in the connecting channel (1*g*) until it reaches a lower seat ring (15) in either the suction valve space (S) or a suction channel (1*j*) in an attachment flange (1*c*).

9. The oscillating displacement pump as claimed in claim 1 or 8, wherein the suction valve space (S) and the pressure valve space (D) are spherical in shape and substantially have the same form and the same characteristic dimensions; and all corresponding structural parts of the valves, such as lids (10, 11) with catch rings (10*a* and 11*a*), respectively, quick-action clamping devices (12*a*, 12*b*), closing members (13, 14) and seat rings (15, 16), are completely identical in form, dimensions, and material.

10. The oscillating displacement pump as claimed in claim 9, wherein the seat ring (15, 16) has a seat seal (15*a* or 16*a*) which is form and force fitted and embedded and preferably consisting of an elastomer vulcanizate.

11. The oscillating displacement pump as claimed in claim 9, wherein the catch ring (10*a*, 11*a*) is connected with the lid (10 or 11) by means of a connecting web (10*b* or 11*b*).

12. The oscillating displacement pump as claimed in claim 9, wherein the lid (10, 11) is form and force fitted on a suction or pressure valve opening (1*k* or 7*c*) by means of a quick-action clamping device (12*a* or 12*b*).

13. The oscillating displacement pump as claimed in claim 9, wherein the closing member (13, 14) is reinforced with a core (13*b* or 14*b*) whose density is greater than that of the casing (13*a* or 14*a*), which is homogeneous and whose position is equidistant from the external surface of the closing member (13, 14).

14. The oscillating displacement pump as claimed in claim 9, wherein the closing member (13, 14) preferably consists of an elastomer vulcanizate (13*a* or 14*a*).

15. The oscillating displacement pump as claimed in claim 14, wherein the closing members (13, 14) are spherical in form.

16. The oscillating displacement pump as claimed in claim 9, wherein the closing members (13, 14) are spherical in form.

17. The oscillating displacement pump as claimed in claim 16, wherein the closing member (13, 14) is reinforced with a core (13*b* or 14*b*) whose density is greater than that of the casing (13*a* or 14*a*), which is homogeneous and whose position is equidistant from the external surface of the closing member (13, 14).

18. The oscillating displacement pump as claimed in claim 16, wherein the axis of the annular catch ring (10*a*, 11*a*) is positioned with a radial offset X in relation to the bore axis of the seat ring (15 or 16).

19. An oscillating displacement pump particularly adapted for pumping a viscous and abrasive liquid pump medium or a pump medium containing solid particles, said pump comprising:

a pumping displacement unit housing defining a displacement unit space for receiving a displacement unit (3), driving a pumping drive means which is acted upon by a hydraulic pressure medium, said pumping drive member having either or both of a constant and variable pumping stroke and stroke frequency;

a pump housing having portions respectively defining a suction valve space (S), a pressure valve space (D), and a connecting space (K), having a suction valve side and a pressure valve side, connecting the suction valve space (S) to the pressure valve space (D) in a direct and straight line connection, the location of the connecting space (K) being further characterized in that the connecting space is located outside of the displacement unit space and is traversed by the pumped medium in such a way that the geodetic height of the pumped medium increases, the connecting space further including a suction valve side connecting channel (1*g*) and a pressure valve side connecting channel (1*h*) connected with each other at any given time during the pump operation through the displacement unit space (P) independent of the position of the displacement unit (3), the suction valve side connecting channel (1*g*) connecting the displacement space (P) in the area of a floor of a housing floor (1*a*) by way of a downward incline with the suction valve side end of the connecting space (K), and the pressure side connecting channel (1*h* ) connecting the displacement unit space (P) by way of an upward incline with the pressure valve side end of the connecting space (K), said displacement unit (3), having a generally vertical direction of motion and the axes of the suction valve space (S), the connecting space (K), and the pressure valve space (D) being generally coincident with the primary direction of flow of a pumped flow through said pump and are aligned with each other, said axes lying parallel to the direction of motion of the displacement unit (3), said suction valve space and said pressure valve space being substantially spherical in shape and having substantially the same form, characteristics, and structural parts as the other, said structral parts including a lid, a catch ring on said lid, a quick-action clamping device, a closing member, and a seat ring, wherein said displacement unit is a plunger piston (3), and means are provided for modifying an otherwise unchanged pump to modify the pump flow, said means being responsive to the diameter ($\phi$ D, $\phi$ d) of a selected plunger piston, said means including a sealing housing (4 or 4*a*), a pressure sleeve (5 or 5*a*), *and a sealing element 6 or 6a*) which are adapted in dependence on the diameter ($\phi$ D, $\phi$ d) of the given plunger piston (3), said pump further including a recess (5*d*) formed over the entire circumference of an inner bore of the pressure (5 or 5*a*), said recess defining with the plunger piston (3), an annular chamber (5*e*) provided with the connection openings (5*c*) for rinsing said annular chamber.

20. An oscillating displacement pump as claimed in claim 19, wherein the closing member in each of said suction valve space and said pressure valve space is spherical in shape.

21. An oscillating displacement pump as claimed in claim 19, wherein said seat ring has a seat seal and said closing member and said seat seal being made from an elastomer vulcanizate.

22. The oscillating displacement pump as claimed in claim 21, wherein each closing member (13, 14) is reinforced with a core (13*b* or 14*b*) whose density is greater than that of the casing (13*a* or 14*a*), which is homogeneous, and whose position is equidistant from the external surface of the closing member (13, 14).

* * * * *

UNITED STATES PATENT AND TRADEMARK OFFICE

CERTIFICATE OF CORRECTION

PATENT NO. : 4,521,163

DATED : June 4, 1985

INVENTOR(S) : FRIEDRICH R.R. STAHLKOPF

It is certified that error appears in the above-identified patent and that said Letters Patent is hereby corrected as shown below:

Column 1, line 37, "pump" should read -- sump --;

Column 4, line 11, "measured" should read -- assured --;

Column 6, line 14, "included" should read --includes--;

Column 6, line 49, "ring" should read -- flange --;

UNITED STATES PATENT AND TRADEMARK OFFICE

CERTIFICATE OF CORRECTION

PATENT NO. : 4,521,163

DATED : June 4, 1985

INVENTOR(S) : FRIEDRICH R.R. STAHLKOPF

It is certified that error appears in the above-identified patent and that said Letters Patent is hereby corrected as shown below:

Column 13, line 65 (Claim 1, line 28), "5 or 5a), should read -- (5 or 5a) --;

Column 14, line 42 (Claim 7, line 3), -- form of a hollow body. -- should be inserted after "the";

Column 16, line 26 (Claim 19, line 49), "structral" should read -- structural --;

Column 16, lines 35 and 36 (Claim 19, lines 58 and 59) "and a sealing element 6 or 6a)" should not be italicized.

Signed and Sealed this

*Twenty-second* Day of *October 1985*

[SEAL]

*Attest:*

*Attesting Officer*

DONALD J. QUIGG

*Commissioner of Patents and Trademarks—Designate*